US005136873A

United States Patent [19]

Hopkins et al.

[11] Patent Number: 5,136,873

[45] Date of Patent: Aug. 11, 1992

[54] AUTOMATIC BLIND RIVET SETTING DEVICE

[75] Inventors: James L. Hopkins, Venice, Fla.; Stuart J. Sandhaus; Daniel Hanlon, both of Pittsburgh, Pa.

[73] Assignee: S.A.R.G. Research Assoc, Ltd., Venice, Fla.

[21] Appl. No.: 792,011

[22] Filed: Nov. 13, 1991

[51] Int. Cl.[5] ..... B21J 15/26; B21J 15/32

[52] U.S. Cl. ..... 72/391.6; 72/452; 29/243.521; 29/243.526

[58] Field of Search ..... 72/391.6, 449, 452; 29/243.521, 243.526

[56] References Cited

U.S. PATENT DOCUMENTS

| | | | |
|---|---|---|---|
| 2,075,162 | 3/1937 | Begg | 29/243.526 |
| 2,340,066 | 1/1944 | Lee | 72/391.6 |
| 2,570,801 | 10/1951 | Hamlin | 72/391.6 |
| 3,033,410 | 5/1962 | Hanneman | 29/243.526 |
| 3,127,045 | 3/1964 | Tschantz | 29/243.526 |
| 3,359,777 | 12/1967 | Lee | 29/243.526 |
| 3,367,166 | 2/1968 | Newton et al. | 72/453.17 |
| 3,557,597 | 1/1971 | Heslop et al. | 72/391.6 |
| 3,657,915 | 4/1972 | Lee | 72/391.6 |
| 3,733,882 | 5/1973 | Klein | 72/391.6 |
| 3,886,783 | 6/1975 | Hirsch | 72/391.6 |
| 3,979,039 | 9/1976 | David | 227/60 |
| 4,027,520 | 6/1977 | Klein | 72/391.6 |
| 4,059,981 | 11/1977 | Holloway | 72/391.6 |
| 4,089,099 | 5/1978 | Nivet | 72/391.6 |
| 4,131,009 | 12/1978 | Hara et al. | 72/391.6 |
| 4,205,547 | 6/1980 | Yamasaka | 72/391.6 |
| 4,506,536 | 3/1985 | Clarke et al. | 72/391.6 |
| 4,604,889 | 8/1986 | Sukharevsky | 72/341.6 |
| 4,628,722 | 12/1986 | Mauer et al. | 72/391.6 |
| 4,630,460 | 12/1986 | Mauer | 72/391.6 |
| 4,744,238 | 5/1988 | Halbert | 72/391.6 |
| 4,747,294 | 5/1988 | Schwartz et al. | 72/391.6 |
| 4,754,643 | 7/1988 | Weeks, Jr. et al. | 72/391.6 |
| 5,035,353 | 7/1991 | Smart et al. | 29/243.52 |

*Primary Examiner*—David Jones
*Attorney, Agent, or Firm*—Charles J. Prescott

[57] ABSTRACT

A blind rivet setting device which automatically feeds blind rivets into a rivet table, then sets the rivet by pulling and detaching the mandrel. The rivet feed mechanism includes a thin strip or ribbon of flexible material capable of holding the mandrel tips pierced therethrough and evenly spaced apart. The strip is drawn through a transverse feed slot formed through the rivet table generally orthogonal to the longitudinal axis of the device. A spring biased retracting device continuously pulls the strip through the feed slot so that the next rivet in succession facing the rivet table is automatically drawn into axial alignment within the rivet table ready for positioning and setting into a work surface. A worm gear with eccentric output drives a connecting rod for pulling and fracturing each mandrel from the rivet body. A flywheel connected between a motor drive and the worm gear arrangement enhances mandrel pulling capacity.

21 Claims, 4 Drawing Sheets

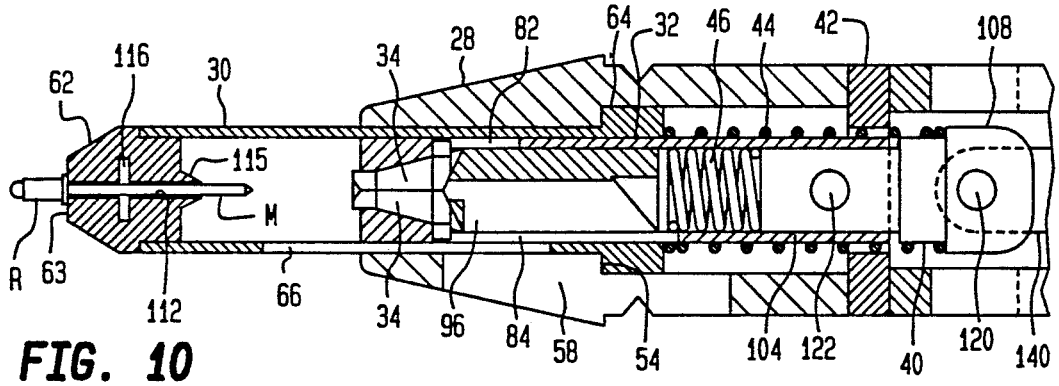
FIG. 10
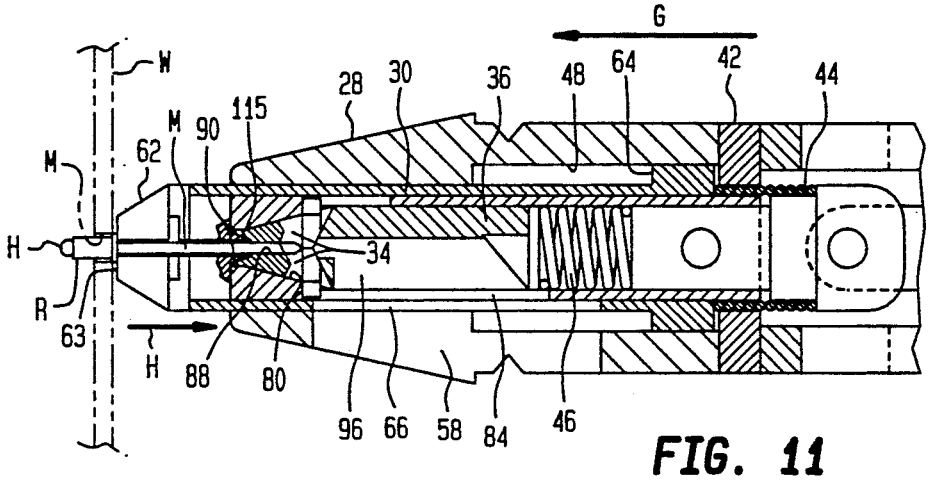
FIG. 11
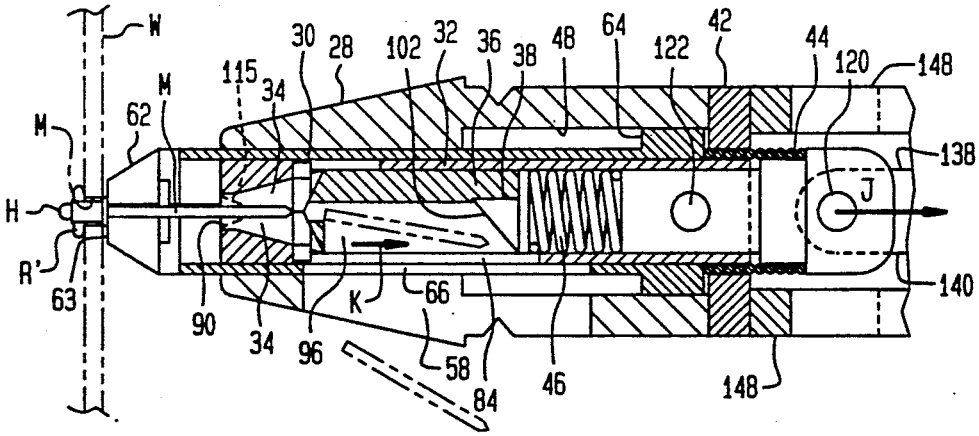
FIG. 12
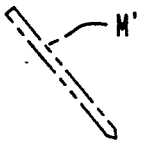

AUTOMATIC BLIND RIVET SETTING DEVICE

BACKGROUND OF THE INVENTION

This invention relates generally to automatic riveting devices, and more particularly to an automatic blind or pop riveting device having an automatic rivet feed means.

Considerable technological effort has been expended in developing blind or pop or mandrel-type rivets, hereinafter collectively referred to as blind rivets, and the associated manually operated devices for setting such rivets. The primary requirement for setting blind rivets is to support the enlarged flange of the rivet body against an anvil or rivet table with the rivet body inserted through a closely mating hole in a work surface. The mandrel extends axially through the rivet table and is gripped by jaws which tension and pull the mandrel rearwardly, expanding the body of the rivet to a point where the mandrel is fractured away. Thus, blind rivets are particularly useful in situations where a conventional riveting tool does not have access to both sides of the working surfaces to be rivet-connected together.

What appears to be a second stage in the development of blind rivets has been toward the automatic setting of the rivet wherein a source of power such as a motor, a pneumatic actuator, or hydraulics, are utilized to replace manual effort in expanding and setting the rivet through mandrel pull.

This riveting technology has also expanded into the development of automatic riveting devices which include an automatic feed means for the rivets themselves. Prior to such development, the user has been required to manually insert each fresh rivet into the rivet table, one at a time. Because these devices still require the user to depress an actuator or trigger to set each rivet, these devices are referred to as "semiautomatic" rivet machines having an automatic feed.

The bulk of these automatic feed rivet devices fall generally into two categories. The first category is one wherein the nosepiece and/or rivet table is pivotally or arcuately connected wherein these components swing apart radially outwardly from one another so that a new rivet may be passed forward longitudinally from behind this arrangement into position, whereupon the nosepiece and/or rivet table components are closed around the rivet body and mandrel with the flange of the rivet against the distal end surface of the rivet table.

The second general category of automatic rivet feed means is directed to an external arm arrangement which swings or pivots a fresh rivet into coaxial alignment forwardly of the rivet anvil and then either automatically draws or allows the rivet to be manually moved fearwardly wherein the mandrel enters the longitudinal aperture of the rivet anvil.

Despite this considerable effort and incentive in developing such an automatic feed rivet machine, nonetheless no such devices known to applicants have been marketed successfully to date. Proper and reliable functioning appears to be a shortcoming of all known prior art devices. Obviously, the market for such a device is extensive, reaching from space station deployment, through both light and heavy industry and aircraft assembly, all the way to the home enthusiast. In each case, the need for a high volume rate of setting blind rivets is the desired end result which has, to date, remained unsatisfied.

The present invention provides such a device which in prototype and preproduction form has operated successfully and reliably to date. This invention offers fully automatic rivet feed means and an accompanying riveter which will set rivets automatically as quickly as an operator can act to position each new rivet into another hole in the work surface. Additionally, the power source for this invention facilitates the setting of extremely large, heavy-duty rivets, as well as smaller lighter-duty rivets without altering the configuration or sizing of the power source.

BRIEF SUMMARY OF THE INVENTION

This invention is directed to a blind rivet setting device which automatically feeds blind rivets into a rivet table, then sets the rivet by pulling and detaching the mandrel. The rivet feed mechanism includes a thin strip or ribbon of flexible material capable of holding the mandrel tips pierced therethrough and evenly spaced apart. The strip is drawn through a transverse feed slot formed transversely through the rivet table generally orthogonal to the longitudinal axis of the device. A spring biased retracting device continuously pulls the strip through the feed slot so that the next rivet in succession facing the rivet table is automatically drawn into axial alignment within the rivet table ready for positioning and setting into a work surface. A worm gear with eccentric output drives a connecting rod for pulling and fracturing each mandrel from the rivet body. A flywheel connected between a motor drive and the worm gear arrangement enhances mandrel pulling capacity.

It is therefore an object of this invention to provide a fully operational, functional and reliable automatic riveting device for setting blind rivets which includes an automatic rivet feed arrangement.

It is yet another object of this invention to provide an automatic riveting device for blind rivets which will set a very broad range of rivet sizes.

It is yet another object of this invention to provide an automatic riveting device for blind rivets which will conveniently and reliably discharge spent mandrels from the device after setting each rivet.

It is still another object of this invention to provide an automatic riveting device for blind rivets which includes a worm drive in combination with an eccentrically driven connecting rod serving as the power transfer arrangement.

It is still another object of this invention to provide an automatic blind rivet feed arrangement for riveting devices.

It is yet another object of this invention to provide an auxiliary drill arrangement as part of an automatic riveting device which is in convenient position to bore holes into a working surface in the same time frame that the rivets are to be set.

In accordance with these and other objects which will become apparent hereinafter, the instant invention will now be described with reference to the accompanying drawings.

BRIEF DESCRIPTION OF THE DRAWINGS

FIG. 10 is an enlarged view of FIG. 3 showing a blind rivet in position within the head of the device ready for placement into a suitable prepared hole in a work surface.

FIG. 11 is a view similar to FIG. 10 except that the rivet has been inserted into the prepared hole and the nose section has been manually compressively retracted to place the mandrel within the jaws.

FIG. 12 is a view similar to FIG. 11 except that the rivet has been expanded and set into the work surface and depicting in phantom the ejection of the spent mandrel.

DETAILED DESCRIPTION OF THE INVENTION

Figures 1, 2, 3:
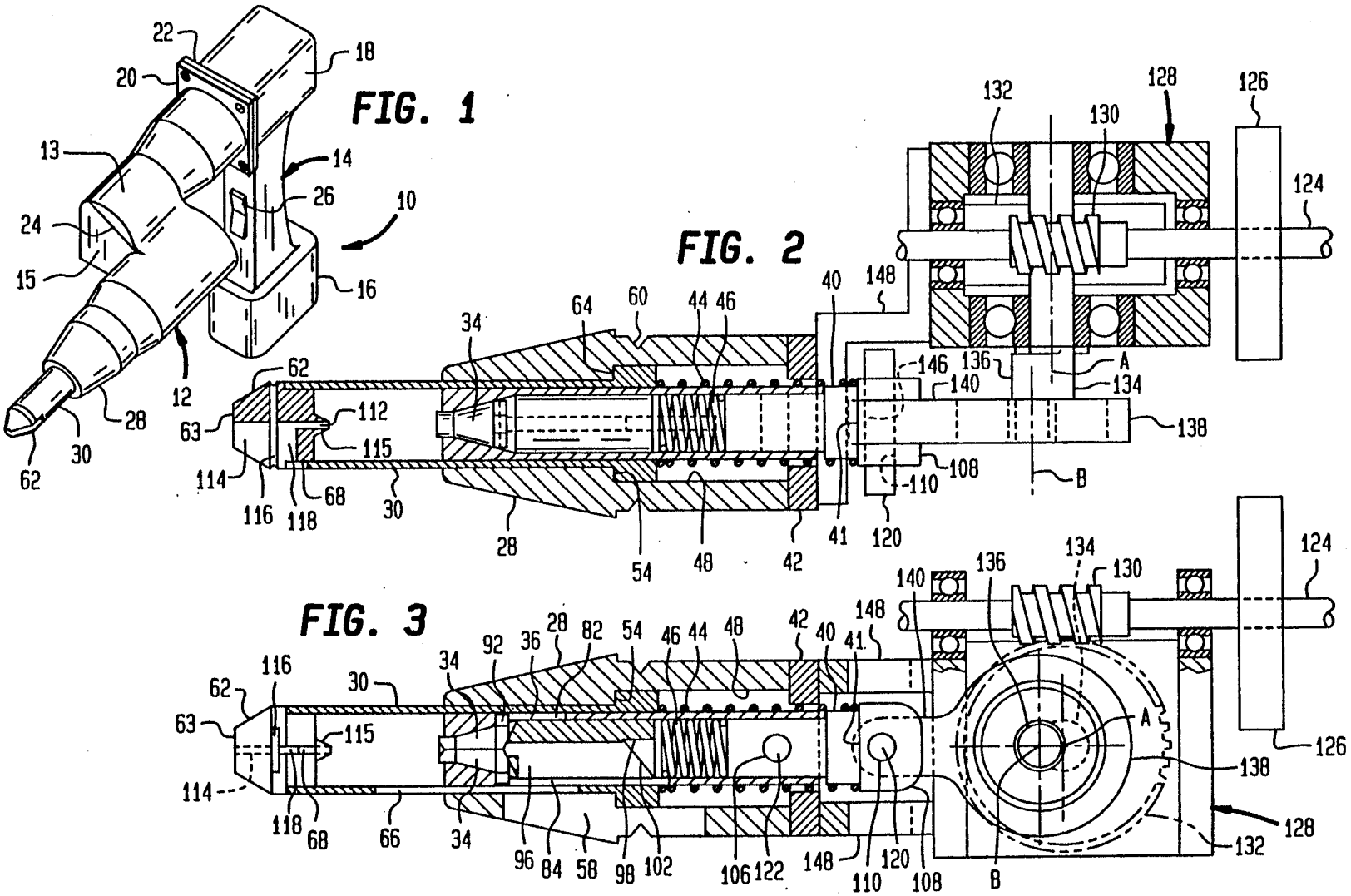
FIG. 1 is a perspective view of the entire device.
FIG. 2 is a top plan section view of the device as shown in FIG. 1 absent the protective enclosure and battery/motor pack.
FIG. 3 is a side elevation section view of FIG. 2.
Figure 4:
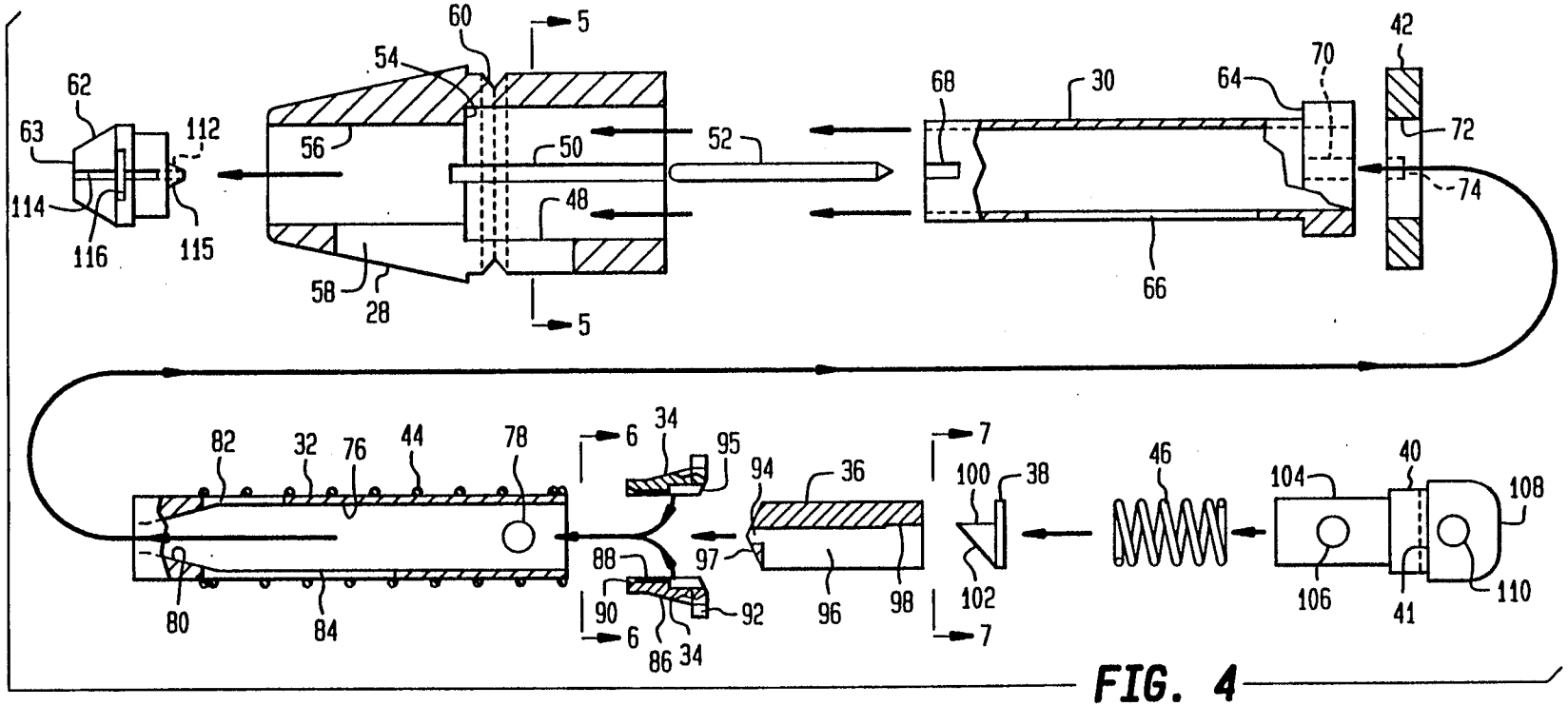
FIG. 4 is an exploded side elevation partial section view of the components comprising the working head of the device detached from the worm gear and eccentric drive.
Figure 7:
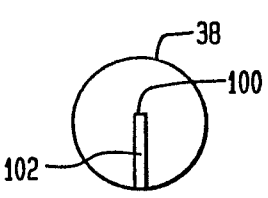
FIG. 7 is a view in the direction of arrows 7—7 in FIG. 4.
Figure 6:
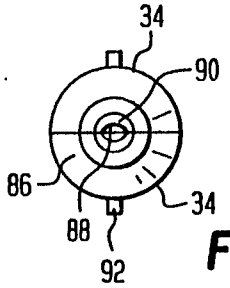
FIG. 6 is a view in the direction of arrows 6—6 in FIG. 4.
Figure 5:
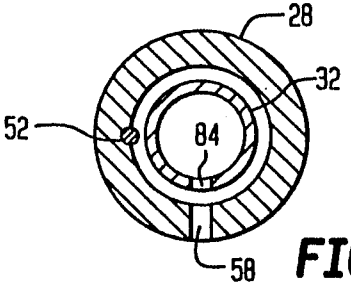
FIG. 5 is a section view in the direction of arrows 5—5 in FIG. 4.

Referring now to the drawings, and particularly to FIG. 1, the preferred embodiment of the invention is shown generally at numeral 10 and generally includes a main rivet setting portion or head 12 and a motor/battery pack 14, both of which include and are bolted together by mounting flanges 20 and 22, respectively. The head 12 includes an outer molded thin plastic housing formed of two housing halves 13 and 15 which mate along parting line 24. A machined aluminum nose section 28 extends forwardly from the housing halves 13 and 15 as will be described herebelow. An outer sleeve 30 having a rivet table 62 secured in the distal end thereof forms the forwardly portion of the head 12.

The motor/battery pack 14 includes a conventional low voltage d.c. motor 18 which is operably connected by trigger 26 to a rechargeable battery 16 and also serves as a handle.

Note that head 12 is shown rotatedly offset from a vertical plane passing through the center of motor/battery pack 14, but is not a required feature, the center line of all components otherwise conveniently lying in the same vertical plane.

Referring additionally to FIGS. 2 to 7, the rivet setting components of the head 12 absent the housing halves 13 and 15 of this invention are there shown. A nosepiece 28 formed of machined aluminum includes a forwardly tapered outer surface and a cylindrical rearwardly portion which lockably engages by groove 60 within mating retaining heads (not shown) in the two part molded housing 13/15. A tubular outer sleeve 30 slidably engages within bore 56 for fore-and-aft longitudinal movement and supportively receives a rivet table 62 within its forwardly end. The enlarged stop 64 at the rearwardly end of outer sleeve 30 contacts against surface 54 when in a forwardly at-rest position, slidably engaging along bore 48 back and forth as will be described herebelow. Pin 52 matably engages within a cylindrical hole formed radially evenly spaced between bore 48 and stop 64 to prevent rotation between outer sleeve 30 and nose section 28, the rearwardly end of pin 52 fitting within pocket 74 of stop plate 42.

A tubular inner sleeve 32 slidably engages within outer sleeve 30 and is structured by its tapered forwardly inner end 80 to matably support and guide a two part set of jaws 34. Jaws 34 include a truncated conical shaped outer surface 86 along their main mid portion which slidably engage against surface 80 and also include a tapered forwardly inner surface 90 leading to a serrated or toothed section 88, and guide tabs 92. These guide flanges 92 slidably engage within longitudinal slots 82 and 84 opposingly formed through the wall of inner sleeve 32.

A cylindrical jaw spreader 36 slidably engages within cylindrical surface 76 of inner sleeve 32. This jaw spreader 36 includes a wedge-shaped forwardly surface 97 having a central longitudinal mandrel receiving aperture 94 formed therethrough. This conical or wedge-shaped surface 97 matably engages against rear surfaces 95 of jaws 34 and, when forwardly biased by spring 46 which acts to urge jaw spreader 36 axially forward, serves to both forwardly bias and spread jaws 34 apart so as to maintain guide tabs 92 within their respective slots 82 and 84.

Jaw spreader 34 also includes mandrel slot 96 which is longitudinally formed and radially extending from the approximate center line of jaw spreader 36.

A mandrel ejecting plate 38 is also provided which slidably mates for fore-and-aft movement within the rearward end of jaw spreader 36 such that edge 100 is closely mated against notch 98 to prevent rotation thereof. A mandrel deflecting surface 102 is formed by blade 100 to function to deflect the spent or broken mandrel from the device as will be described herebelow. Compression spring 46 acts against the rearward surface of ejecting plate 38 so as to urge jaw spreader 36 forwardly.

To complete this head 12 (absent housing) as a subassembly, a clevis 40 matably engages within inner surface 76 of inner sleeve 32 and is secured there by transverse pin 122 fitted within aligned transverse holes 78 and 106, respectively. The forwardly end of clevis 40 thus acts against the rearwardly end of spring 46 to compress same as previously described.

A compression spring 44 which slidably engages over inner sleeve 32 acts at its rearwardly end against surface 41 of clevis 40 and, at its forwardly end, against the rear surface of stop 64. This arrangement is maintained and partially controlled by the secured positioning and eccentric movement of a connecting rod 138 acting through connecting pin 120 aligned through mating holes 110 in clevis 40 and 146 in the forwardly end 140 of connecting rod 138.

From the above, it should now be understood that outer sleeve 30 is movable axially fore and aft within nose section 28 against spring 44 between a forwardly at-rest position wherein stop 64 acts against surface 54 and a rearwardly position wherein stop 64 acts against stop plate 42. Similarly, the axially fore and aft positioning of inner sleeve 32 is controlled by the fore and aft movement of clevis 40 which, in turn, is controlled by driven eccentric rotation of connecting rod 138 about axis A as will be described herebelow. Clevis 40, acting against spring 46, urges jaw spreader 36 forwardly against the rearward surfaces 95 of jaws 34 so as to maintain the jaws in the forwardly at rest position as shown in FIGS. 2 and 3.

The drive transmission arrangement is best seen in FIGS. 2 and 3 and includes a gear housing 128 within which is mounted a worm wheel 132 secured to crank shaft 134. Worm gear 130 is connected to drive shaft 124 which, when rotatably driven by motor 18, causes worm wheel 132 and crank shaft 134 to rotate about axis A. Connecting rod 138 is rotatably connected to offset shaft 136 of connecting rod 34 about axis B so that the offset between axis A and axis B produces the eccentric driving movement of connecting rod 138.

To enhance the mandrel pulling capacity of this drive train, a fly wheel 126 is connected to drive shaft 124 to provide additional inertia for breaking the mandrel as will be described herebelow.

Gear housing 128 is connected to stop plate 42 by brackets 148 which are spaced apart to allow clearance for the movement of clevis 40 and spring 44 therearound.

Figure 8:
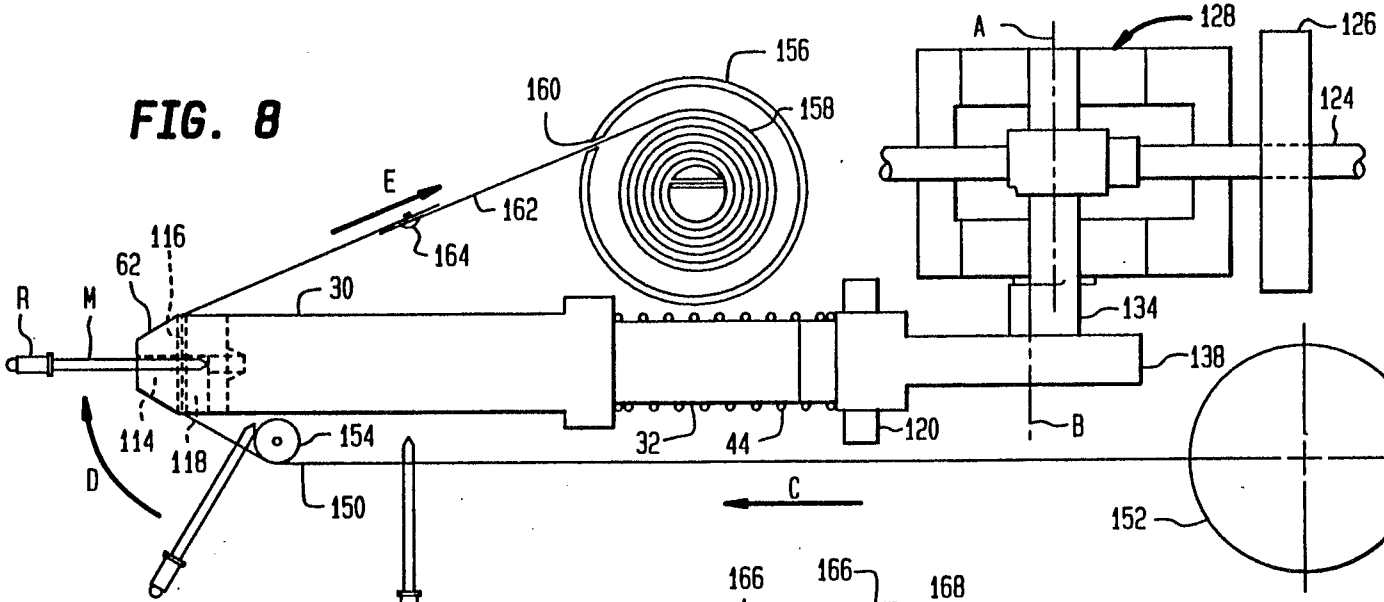
FIG. 8 is a top plan schematic view of the device depicting the automatic rivet feed arrangement.

Referring now to FIG. 8, a rivet feed mechanism is there shown schematically. Rivet table 62 as also most clearly shown in FIGS. 2 and 10, includes a transverse slot 116 and coplaner radially extending longitudinal slots 114 and 118. A longitudinal slot 68 is also formed in the forward end of outer tube 30 which aligns with longitudinal slot 118.

The blind rivets R are held within a thin MYLAR, nylon or plastic strip 150 by inserting the distal tip portion of each mandrel M partially therethrough as shown. The MYLAR strip 150 is of sufficient strength so that, when the tips of the mandrels M are pierced or heat formed therethrough, they are securely retained until drawn into the rivet table 62 and set by the rivet device as will be described herebelow.

The MYLAR strip 150 and rivets R held therein are stored within container 152 and fed forwardly therefrom in the direction of arrow C around roller 154. The free end of MYLAR strip 150 is fed transversely through slot 116 in the direction of arrow D and pulled in the direction of arrow E until the first mandrel M of the first rivet R enters into coaxial alignment within mandrel aperture 112. The MYLAR strip 150 is connected by pin 164 to the distal end 162 of spiral-wound retracting spring 158 of retractor 156. The retracting spring 162 feeds into and out of retractor housing 156 through slot 160.

By this arrangement shown in FIG. 8, the rivets R are sequentially and automatically brought into coaxial alignment within rivet table 62 each time the mandrel M is fractured from rivet R as it is set within a work surface. This setting action also tears the rivet R from the mylar strip 150 as the rivet R is set. Note that the lengths of slots 68 and 118 establish the length of the mandrel tip portion extending through the MYLAR strip 150 and may easily be varied as desired.

Figure 9:
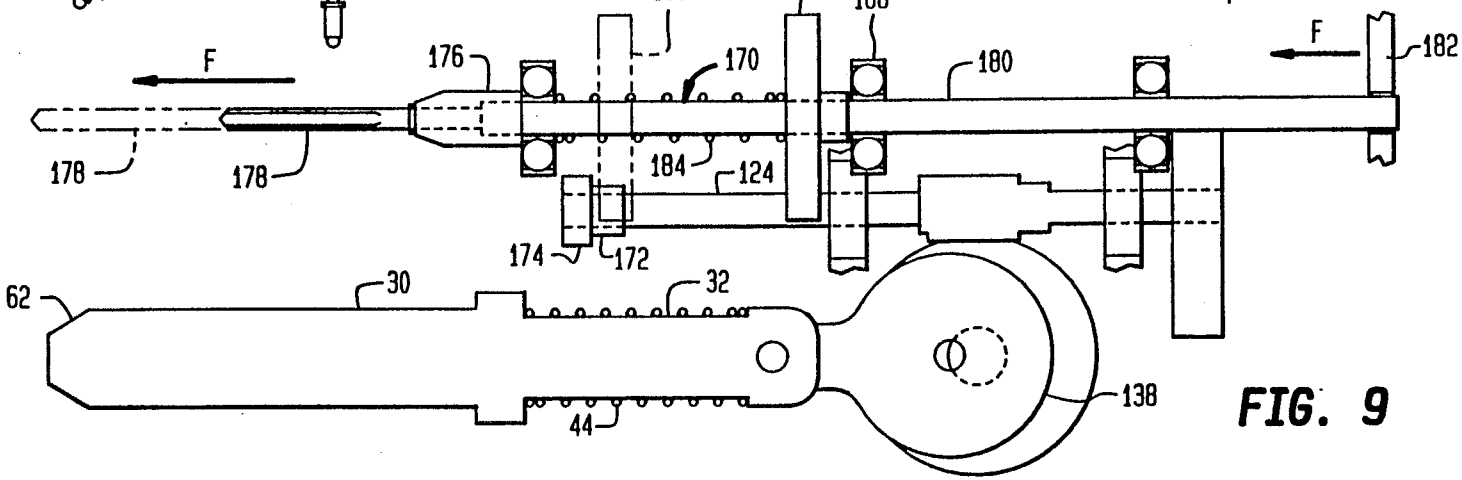
FIG. 9 is a side elevation schematic view of the invention depicting an auxiliary movable drill accessory.

Referring now to FIG. 9, an accessory drill attachment is there shown schematically at numeral 170. This drill accessory 170 includes a secondary drive shaft 180 which is rotatably driven by gear 166 which engages gear 172 on drive shaft 124 when moved forwardly into the position shown in phantom. An additional bearing 174 is provided to support the distal end of drive shaft 124.

Auxiliary drive shaft 180 is supported within bearings 168 for axial longitudinal forward translation in the direction of arrow F. This movement is effected by manual manipulation of handle 182. Thus, when auxiliary drive shaft 180 is fully forward, drill chuck 176 and drill bit 178 secured therewithin begin to rotate by the driving interaction between gears 172 and 166. When in the drivingly engaged position, drill bit 178 in phantom extends beyond the rivet anvil 162 for work surface engagement. Spring 184 maintains the arrangement rearwardly in an at-rest position.

SEQUENCE OF OPERATION

Referring now to FIGS. 10, 11 and 12, the sequence of operation of rivet setting is there depicted. In FIG. 10, the rivet R is shown within rivet anvil 62 with mandrel M fully inserted through longitudinal aperture 112. In this position, the head of rivet R is also fully engaged against the distal transverse surface 63 of rivet table 62.

To commence the rivet setting operation, the rivet R is inserted into a prepared hole M in a work surface W. By manual movement of the nosepiece 58 in the direction of arrow G, the outer sleeve 30 is forcibly retracted in the direction of arrow H, thus compressing spring 44. This retraction terminates when stop 64 contacts stop plate 42.

When in the position shown in FIG. 11, the mandrel M becomes inserted within jaws 34 as shown. The teeth or serrations 88 will then grip against and retain the mandrel M, assisted by the forwardly biasing of jaw spreader 36 by spring 46 as previously described. The conical tapered outer surfaces 86 of jaws 34, when urged forwardly in this manner, will cause the serrations 88 to tightly dig into and grip mandrel M, thus preventing the outer sleeve 30 from extending forwardly back to its at-rest position shown in FIG. 10.

In FIG. 12, the motor 18, (FIG. 1) is activated and the shank 140 with connecting rod 138 is eccentrically drawn rearwardly in the direction of arrow J by the worm gear arrangement previously described. The "throw" of the eccentric drive shaft 134, i.e. twice the distance between axis A and axis B shown in FIGS. 2 and 3, may be chosen to be in excess of the anticipated pull required to set rivet R and to fracture the mandrel M therefrom. However, typically this "throw" per each revolution of the crankshaft 134 will be somewhat less than that amount. Therefore, several revolutions of crankshaft 134 will be required to pull and fully set the rivet into the configuration R' and to fracture the mandrel M therefrom.

As a consequence of the repeated number of revolutions required to fully set each rivet R' and fracture the mandrel M therefrom, the jaws 34 must be repeatedly disengaged from the mandrel M and then be reclamped therearound, each time successively closer to the rivet R for each cycle. To help accomplish this, a rearward conical extension 115 of rivet table 62 is configured so as to slightly contact the jaws 34 within surface 90 so as to very slightly urge the jaws 34 rearwardly from their forwardly most position. This movement is in the range of 0.001" to 0.010" when the inner sleeve 32 is in its forwardly, at-rest position. Thus, in FIG. 12, with each revolution of crank shaft 134 and the rearward movement of pin 120 in the direction of arrow J, jaws 34 are urged to their forwardly most position by jaw spreader 36 and are then slightly urged rearwardly by rivet table extension 115 when the inner tube 32 returns to its fully forward, at-rest position. By this arrangement, then the repeated release of the grip of jaws 34 around mandrel M followed by a secure reengagement therearound is effected.

It has been found that this slight rearward urging of the jaws 34 as inner tube 32 returns to its fully forward, at-rest position is an important feature of the present invention in that the jaws 34 may not otherwise easily release their grip around mandrel M so as to allow for a fresh grip therearound closer to the head of the rivet R.

When the head 12 of mandrel M has been pulled sufficiently rearwardly with respect to rivet R and the work surface W, and the enlarged head H of mandrel M has sufficiently mushroomed or expanded rivet R into the configuration R', the mandrel M will then fracture or break away from head 12. To clear the spent mandrel M', four separate slots, 96 and jaw spreader 36, 84 in inner sleeve 32, 66 in outer sleeve 30, and 58 in nose section 28 to allow the spent mandrel M' to discharge from the device as shown in phantom in FIG. 12.

To assist in the lateral deflection of the spent mandrel M', the diagonal surface 102 of ejection plate 38 comes into play. The rearward distal end of spent mandrel M' strikes surface 102 as it is propelled rearwardly in the direction of arrow K. Lateral and rotational deflection of the spent mandrel M' is thus commenced and effected as shown sequentially in phantom.

An additional feature of the ejection plate 38 may now be appreciated. Occasionally, a spent mandrel M' will jam within slot 96 of jaw spreader 36. To prevent this occurrence, spring 46 allows the ejection plate 38 to move rearwardly slightly, depending on the force exerted by the striking spent mandrel M'. This biased movement of ejection plate 38 has been shown to prevent jamming in this circumstance.

As previously noted, a flywheel 126 may be provided which will add a smoothing inertia force for setting larger rivets and fracturing the mandrel therefrom. Thus, once the motor has been energized for repeated gripping and rearward pulling of the mandrel, the flywheel 126 inertia adds to the pulling capacity of the motor/gear/eccentric arrangement.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A blind rivet setting device comprising:

a nose section defining a longitudinal passage therethrough and having a forward and a rearward end;

an elongated tubular outer sleeve longitudinally slidably mounted within said nose section passage between an at rest position wherein a forward end of said outer sleeve extends beyond said nose section forward end a first preselected distance and a retracted position wherein said outer sleeve forward end extends beyond said nose section forward end a second preselected distance smaller than said first preselected distance;

said outer sleeve spring biased toward said at rest portion;

a rivet table connected to said outer sleeve forward end and forwardly extending therefrom including a longitudinal aperture therethrough sized to slidably receive a mandrel of a blind rivet and to support a rivet head against a distal transverse surface of said rivet table;

an elongated tubular inner sleeve coaxially aligned with, and slidably mounted within, said outer sleeve and having a plurality of movable jaws disposed within a forward end of said inner sleeve, said plurality of jaws defining a mandrel passage therealong axially aligned with said rivet table aperture sized to slidably receive the mandrel passing rearwardly therethrough;

said plurality of jaws cooperatively structured with said inner sleeve to permit the radial size of said mandrel passage to increase as said plurality of jaw sections are moved rearwardly within said inner sleeve;

an elongated jaw spreader slidably positioned within said inner sleeve behind and axially aligned with said plurality of jaws, said jaw spreader forwardly biased against said plurality of jaws whereby said plurality of jaws are also forwardly biased;

said jaw spreader also including an elongated longitudinal slot laterally extending to an outer surface thereof in one direction along substantially the entire length of said jaw spreader;

said inner sleeve pivotally connected at a rearwardly point thereof to a forwardly point of a connecting rod, a rearwardly point of said connecting rod eccentrically driven in a plane including the longitudinal axis of said inner sleeve by a motor and gear arrangement, said inner sleeve pulled from a forwardly to a rearwardly position with respect to said outer sleeve and said nose section and returned to the forwardly position during each eccentric cycle of said connecting rod;

said plurality of jaws structured to grippingly engage the mandrel of each blind rivet positioned within said rivet table when said outer sleeve is moved to said retracted position, the mandrel being drawn further rearwardly to set the blind rivet and to be detached therefrom after at least one cycle of said connecting rod;

said detached mandrel laterally ejected away from said device through said jaw spreader slot and mating and aligned slots through the walls of said inner outer sleeves and said nose section.

2. A blind rivet setting device as set forth in claim 1, further comprising:

means for automatically feeding one blind rivet at a time laterally into said rivet table, a distal end portion of each mandrel entering into axial alignment with said rivet table aperture through a longitudinal mandrel receiving slot extending laterally in one direction therefrom to an outer surface of said rivet table.

3. A blind rivet setting device as set forth in claim 2, wherein:

said automatic rivet feed means includes an elongated strip of thin flexible material having a lead end and a plurality of blind rivets connected in spaced apart relation along the length of said flexible strip by having the distal portion of each mandrel pierced through and retained within said flexible strip;

said flexible strip slidably feeding through a transverse feed slot formed through said rivet table, said feed slot orthogonally intersecting said mandrel receiving slot;

biased means connected to said lead end for pulling said flexible strip through said transverse slot to draw each mandrel of each blind rivet held in said flexible strip and positioned immediately adjacent said rivet table one at a time into said rivet table aperture through said mandrel receiving slot.

4. A blind rivet setting device as set forth in claim 1, further comprising:

an ejection plate connected to a rearward end of said jaw spreader;

said ejection plate including a longitudinally oriented blade having a diagonal deflecting surface positioned at the rearward end of said jaw spreader slot;

said deflecting surface structured to be struck by and to laterally redirect the distal end of each detached mandrel when fractured from each blind rivet head after setting.

5. A blind rivet setting device as set forth in claim 4, wherein:

said ejection plate is forwardly spring biased against said jaw spreader and rearwardly movable against said spring bias to prevent jamming of detached mandrels.

6. A blind rivet setting device as set forth in claim 1, wherein:

said gear arrangement includes a worm connected to said motor in driving engagement with a helical worm wheel, said worm wheel in eccentric driving communication with the rearward end of said connecting rod.

7. A blind rivet setting device as set forth in claim 6, further comprising:

a flywheel rigidly connected coaxially between said motor and said worm.

8. A blind rivet setting device comprising:

a rivet table having a longitudinal aperture therethrough connected to a free exposed end of an elongated tubular outer sleeve, said outer sleeve held for limited back and forth slidable longitudinal movement within a nose section, said outer sleeve biased forwardly within said nose section;

means for automatically feeding one blind rivet at a time into said rivet table, a distal end portion of each mandrel entering said rivet table aperture through a longitudinal mandrel receiving slot extending transversely in one direction from said aperture;

a set of jaws operably connected within a forward end of an elongated tubular inner sleeve slidably mounted for longitudinal movement within said outer tube;

said jaw set forwardly biased to grippingly engage around a mandrel of a blind rivet positioned in said rivet table when said outer sleeve is rearwardly retracted into said nose section;

rivet setting and mandrel separation means connected to a rearwardly point of said inner sleeve for forcibly urging said jaw set grippingly engaged around the mandrel and said inner sleeve rearwardly within said outer sleeve whereby the rivet is expanded and set and the mandrel is fracturably detached therefrom;

ejection means aligned through said inner and outer sleeves and said nose section for ejecting each forcibly detached mandrel laterally away from said device.

9. A blind rivet setting device as set forth in claim 8, wherein:

said automatic rivet feed means includes an elongated strip of thin flexible material having a lead end and a plurality of blind rivets connected in spaced apart relation along the length of said flexible strip by having the distal portion of each mandrel pierced through and retained within said flexible strip;

said flexible strip slidably feeding through a transverse feed slot formed through said rivet table, said feed slot orthogonally intersecting said mandrel receiving slot;

biased means connected to said lead end for pulling said flexible strip through said transverse slot to draw each mandrel of each blind rivet held in said flexible strip and positioned immediately adjacent said rivet table one at a time into said rivet table aperture through said mandrel receiving slot.

10. A blind rivet setting device as set forth in claim 8, wherein:

said rivet setting and mandrel separation means includes a connecting rod having a forward end pivotally connected to said inner sleeve rearwardly point and a rearward end eccentrically driven by a motor and gear arrangement, said inner sleeve pulled from a forwardly to a rearwardly position with respect to said outer sleeve and said nose section and returned to the forwardly position during each eccentric cycle of said connecting rod.

11. A blind rivet setting device as set forth in claim 10, wherein:

said gear arrangement includes a worm connected to said motor in driving engagement with a helical worm wheel, said worm wheel in eccentric driving communication with the rearward end of said connecting rod.

12. A blind rivet setting device as set forth in claim 11, further comprising:

a flywheel rigidly connected coaxially between said motor and said worm.

13. A blind rivet setting device as set forth in claim 8, further comprising:

an ejection plate connected to a rearward end of an elongated jaw spreader slidably positioned within said inner sleeve behind and axially aligned with said plurality of jaws, said jaw spreader forwardly biased against said plurality of jaws whereby said plurality of jaws are also forwardly biased;

said jaw spreader also including an elongated longitudinal slot laterally extending to an outer surface thereof in one direction along substantially the entire length of said jaw spreader;

said ejection plate including a longitudinally oriented blade having a diagonal deflecting surface positioned at the rearward end of said jaw spreader slot;

said deflecting surface structured to be struck by and to laterally redirect the distal end of each detached mandrel when fractured from each blind rivet head after setting.

14. A blind rivet setting device as set forth in claim 13, wherein:

said ejection plate is forwardly spring biased against said jaw spreader and rearwardly movable against said spring bias to prevent jamming of detached mandrels.

15. A blind rivet setting device comprising:

a hollow nose section and a rivet table connected at a distal end of outer tubular means longitudinally slidable within said nose section, said outer tubular means for translating said rivet table from an extended at-rest position to a retracted position, said outer tubular means spring biased toward said at-rest position;

means for automatically feeding a mandrel of a blind rivet one at a time laterally into a longitudinal aperture in said rivet table through a longitudinal mandrel receiving slot extending transversely in one direction from said aperture;

jaw means forwardly biased and slidably mounted within said outer tubular means for gripping each mandrel when said outer tubular means is moved to aid retracted position;

rivet setting and mandrel separating means connected to said jaw means for pulling and detaching the mandrel longitudinally away from the rivet head and for laterally ejecting each detached mandrel.

16. A blind rivet setting device as set forth in claim 15, wherein:

said automatic rivet feed means includes an elongated strip of thin flexible material having a lead end and a plurality of blind rivets connected in spaced apart relation along the length of said flexible strip by having the distal portion of each mandrel pierced through and retained within said flexible strip;

said flexible strip slidably feeding through a transverse feed slot formed through said rivet table, said feed slot intersecting said mandrel slot;

biased means connected to said lead end for pulling said flexible strip through said transverse slot to draw each mandrel of each blind rivet held in said flexible strip and positioned immediately adjacent said rivet table one at a time into said rivet table aperture through said mandrel receiving slot.

17. A blind rivet setting device as set forth in claim 15, further including:

an ejection plate mounted within said outer tube rearward of said jaw means;

said ejection plate including a longitudinally oriented blade having a diagonal deflecting surface;

said deflecting surface structured to be struck by and to laterally redirect the distal end of each detached mandrel when fractured from each blind rivet head after setting.

18. A blind rivet setting device as set forth in claim 17, wherein:

said ejection plate is forwardly spring biased and rearwardly movable against said spring bias to prevent jamming of detached mandrels.

19. A blind rivet setting device as set forth in claim 15, wherein: 'said rivet setting and mandrel separation means includes a connecting rod having a forward end pivotally connected to said inner sleeve rearwardly point and are rearward end eccentrically driven by a motor and gear arrangement, said inner sleeve pulled from a forwardly to a rearwardly position with respect to said outer sleeve and said nose section and returned to the forwardly position during each eccentric cycle of said connecting rod.

20. A blind rivet setting device as set forth in claim 19, wherein:

said gear arrangement includes a worm connected to said motor in driving engagement with a helical worm wheel, said worm wheel in eccentric driving communication with the rearward end of said connecting rod.

21. A blind rivet setting device as set forth in claim 20, further comprising:

a flywheel rigidly connected coaxially between said motor and said worm.

* * * * *